US009233819B2

(12) United States Patent
Wagner et al.

(10) Patent No.: US 9,233,819 B2
(45) Date of Patent: Jan. 12, 2016

(54) METHOD AND APPARATUS FOR DETERMINING ACTUAL AND POTENTIAL FAILURE OF HYDRAULIC LIFTS

(75) Inventors: Ronald E. Wagner, Fleming Island, FL (US); Robert A. Lingis, Gainesville, FL (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 785 days.

(21) Appl. No.: 12/807,886

(22) Filed: Sep. 16, 2010

(65) Prior Publication Data

US 2014/0052348 A1 Feb. 20, 2014

Related U.S. Application Data

(60) Provisional application No. 61/342,130, filed on Apr. 9, 2010.

(51) Int. Cl.

| | |
|---|---|
| ***B66F 17/00*** | (2006.01) |
| ***B66F 11/00*** | (2006.01) |
| ***B66F 11/04*** | (2006.01) |

(52) U.S. Cl.

CPC ..... *B66F 17/006* (2013.01); *B66F 11/046* (2013.01)

(58) Field of Classification Search

CPC ..... B66F 11/00; B66F 11/04

USPC ..... 701/50; 361/178; 212/238, 278; 714/47

See application file for complete search history.

(56) References Cited

U.S. PATENT DOCUMENTS

| | | | | |
|---|---|---|---|---|
| 4,160,492 | A * | 7/1979 | Johnston | B66F 11/046 182/148 |
| 5,159,989 | A * | 11/1992 | Claxton | B60S 9/12 180/41 |
| 5,557,526 | A * | 9/1996 | Anderson | 701/50 |
| 5,934,409 | A * | 8/1999 | Citron | B66C 23/78 182/17 |
| 6,173,810 | B1 * | 1/2001 | Citron | B66C 23/78 182/17 |
| 6,405,114 | B1 * | 6/2002 | Priestley | B66F 11/046 182/18 |
| 7,180,720 | B2 * | 2/2007 | Ichimura | 361/178 |
| 8,490,746 | B2 * | 7/2013 | Cummings | B66F 11/046 182/18 |
| 8,631,651 | B2 * | 1/2014 | Elliott | B66C 13/20 60/463 |
| 2007/0158920 | A1 * | 7/2007 | Delaney | B60G 17/0195 280/5.514 |
| 2010/0083056 | A1 * | 4/2010 | Spier et al. | 714/47 |

* cited by examiner

*Primary Examiner* — Thomas Tarcza
*Assistant Examiner* — Tyler J Lee
(74) *Attorney, Agent, or Firm* — Daniel J. Long

(57) ABSTRACT

An early warning system includes monitoring of the hydraulic pressure used to power the hydraulic motor used to raise a man lift during operation, and providing a prognostication algorithm coupled to the output of the sensor to predict based on data from the sensor when there will be a catastrophic failure of the lift.

16 Claims, 7 Drawing Sheets

METHOD AND APPARATUS FOR DETERMINING ACTUAL AND POTENTIAL FAILURE OF HYDRAULIC LIFTS

RELATED APPLICATIONS

This application claims rights under 35 USC §119(e) from U.S. Application Ser. No. 61/342,130 filed Apr. 9, 2010, the contents of which are incorporated herein by reference.

FIELD OF THE INVENTION

This invention relates to man lifts and more particularly to a system for predicting catastrophic failure.

BACKGROUND OF THE INVENTION

In a utilities environment where there is a man lift, the lift is elevated by hydraulic pressure in which a bucket is raised above horizontal through a hydraulically actuated lift structure including an extensible boom with a bucket attached to the distal end thereof. The boom is pivoted, usually on a truck, and the boom is actuated lifted to a controllable position. The lifting of the boom from a horizontal is called above rotation and if there is a hydraulic failure, the bucket with the individual crashes to the ground causing injury.

Thus if hydraulic pressure is lost during operation the result is catastrophic and the lift collapses.

In the past there has been no method or apparatus to ascertain when the hydraulic pressure is going to release and therefore there can be no early warning of the collapse of the lift.

SUMMARY OF INVENTION

In order to provide for an early warning of the potential collapse of a lift, the hydraulic pressure to the hydraulic motor is monitored, with the sensor output provided to a PRDICTR algorithm which predicts based on data from the sensor when there will be a catastrophic failure in terms of a hydraulic pressure release. One suitable PRDICTR algorithm is described in U.S. patent application Ser. No. 12/548,683 by Carolyn Spier filed on Aug. 27, 2009, assigned to the assignee hereof and incorporated herein by reference.

In one embodiment, the PRDICTR algorithm operates on changes in hydraulic pressure which it monitors such that the pressure sensor is utilized to continually sense the pressures in an under stress hydraulic man lift.

The subject senses changes in pressures and, if significant, prognosticates that a catastrophic failure is imminent.

The PRDICTR algorithm is initialized with expected hydraulic pressures for the installation in question and that which is sensed is the pressure during the operation of the lift so that one is measuring pressure when a man is up on the lift. The prognostication software is utilized in order to provide an alarm indication when changes in the pressure when the lift is in operation indicate the imminence of a catastrophic failure.

In summary, an early warning system includes monitoring of the hydraulic pressure used to power the hydraulic motor used to raise a man lift during operation, and providing a prognostication algorithm coupled to the output of the sensor to predict based on data from the sensor when there will be a catastrophic failure of the lift.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
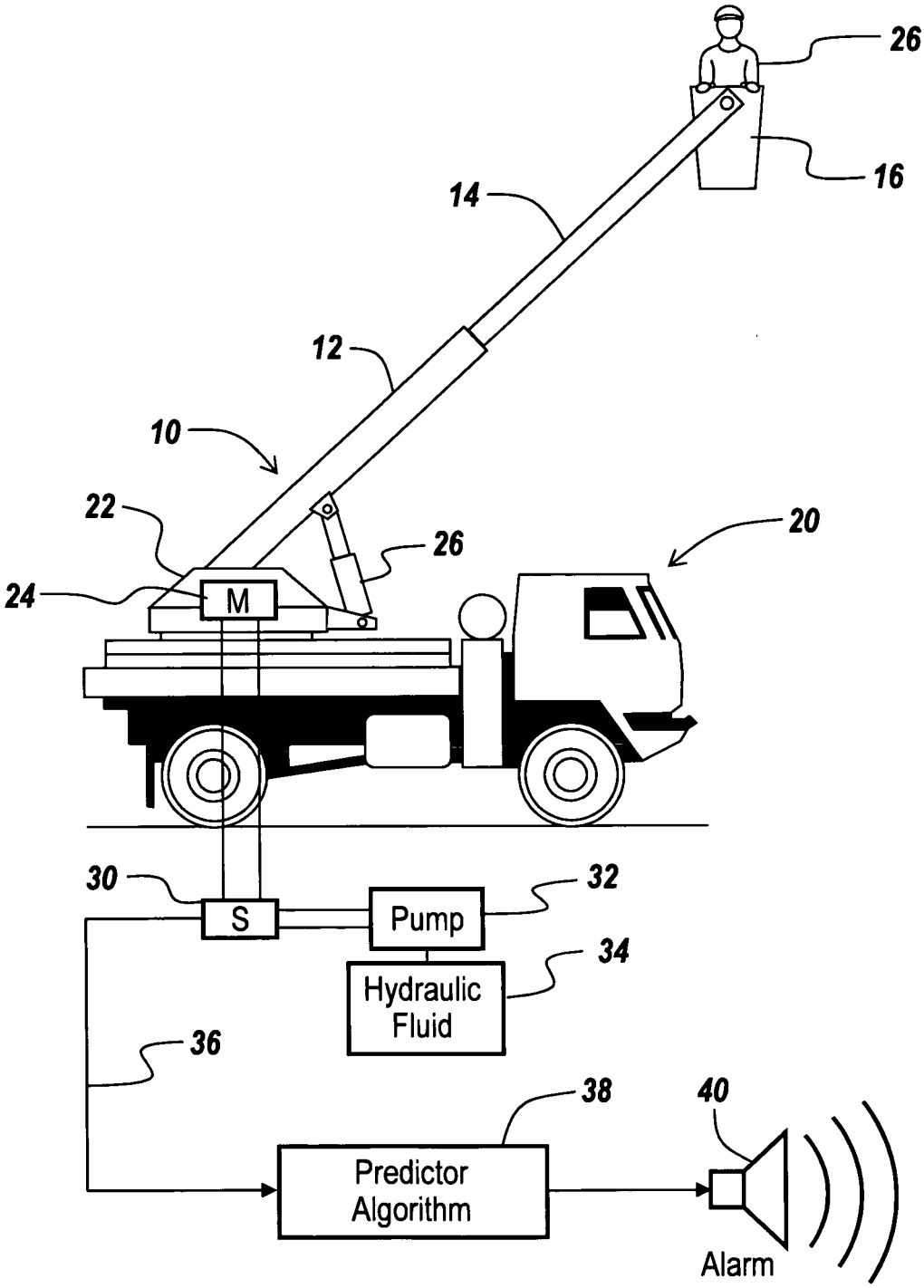
FIG. 1 is a diagrammatic illustration of a man lift in operation showing a sensor interposed in the hydraulic path between the hydraulic fluid pump and the motor utilized in the lift, also indicating the utilization of the PRDICTR algorithm to provide an early warning of catastrophic failure; and, FIG. 2 is a diagrammatic illustration of the hydraulic man lift of FIG. 1 illustrating a boom elevated to an out of rest status corresponding to an above rotation of the boom, with an above rotation hydraulic sensor being utilized to sense the hydraulic pressure during boom operation.

Referring now to FIG. 1, a hydraulic lift 10 includes a boom 12 which is extensible by a telescopic boom element 14 and which carries a bucket 16 at the distal end thereof. The lift is mounted on a vehicle 20 which includes a pivoted base and lift module 22 that contains a hydraulic motor 24 utilized to power a hydraulic ram 26 to raise boom 12 to the appropriate position so as to position bucket 16 at the appropriate location.

It is noted that bucket 16 carries an individual 26, the safety of whom is paramount.

In order to provide for a early warning to assure the safety of individual 26, a sensor 30 is provided in the fluid path between a hydraulic pump 32 and a hydraulic motor 24, with the pump being provided with a source of hydraulic fluid 34.

The output 16 of sensor 30 is coupled to a PRDICTR algorithm 38 which operates on changes in pressure sensor 30 to predict catastrophic failure. The PRDICTR algorithm 38 does this by initializing the PRDICTR algorithm with pressures that would be expected throughout the operation of the lift. When these pressures during elevation of the lift drop below a predetermined level or change by more than a predetermined amount, then the PRDICTR algorithm 38 senses such changes that indicate the potential of a catastrophic failure and activates an alarm 40.

Figure 2:
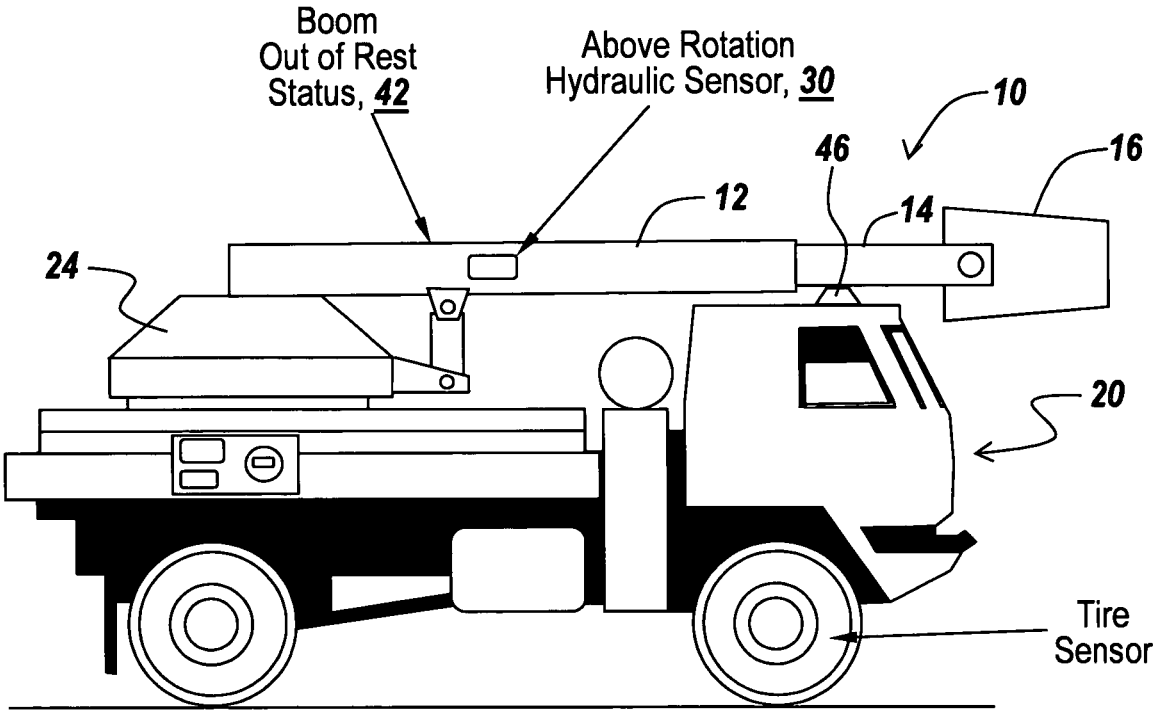

Referring now to FIG. 2, vehicle 20 is provided with base 24 and lift 10 having its booms 12 and 14 in a horizontal or down position just above the rest position, namely an above rotation position.

When the boom is out of rest as illustrated at 42 the above rotation hydraulic sensor 30 senses the pressure to maintain the boom in position.

If the pressure from pressure sensor 30 which is continuously monitored changes abruptly or even over time by an amount that is indicative of a potential failure, then an alarm is sounded and the boom is rotated to its rest position on rest stop 46 so that the lift operator can exit the bucket.

Figure 3:
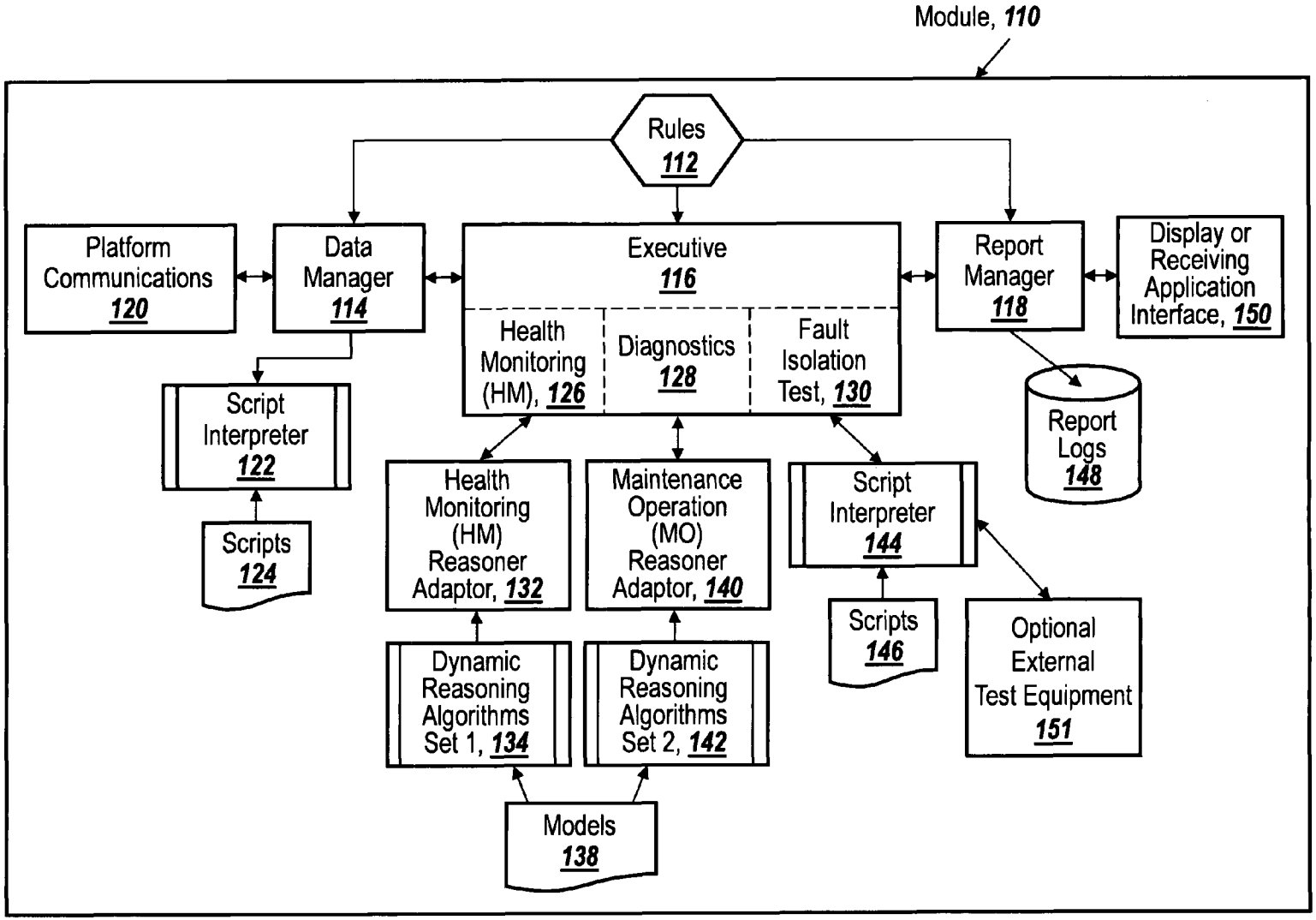
FIG. 3 is a diagrammatic representation of the prognostic, diagnostic capability tracking system module illustrating the configuration of the module using a rules set that is coupled to a data manager, an executive program and a report manager, with the data manager coupled to a script interpreter and with the executive program including a health monitoring, diagnostics and fault isolation test functions; and, FIGS. 4-8 are flow charts describing the operation of the module of FIG. 3.

As to the prognostic properties exhibited by the PRDICTR algorithm, referring now to FIG. 3, the PRDICTR system uses a module 110 either embedded or connected to a platform or LRU which performs a prognostic and diagnostic function to detect faults and to analyze and diagnose the causes of the faults of the platform to which it is coupled.

In order for the module to adapt to any of a wide variety of applications, module 110 is provided with a rules engine 112 which is coupled to a data manager 114, an executive program 116 and a report manager 118.

The rules are modified or adapted for each of the platforms or LRUs the module is to monitor, with platform communications 120 connecting module 110 to the particular platform involved.

Data manager 114 is coupled to a script interpreter 122 which is provided with scripts 124, thus to be able to translate the platform communications format to a universal format usable by module 110 as well as to perform translation, and transformation of the input data.

Executive program 116 controls three functions, namely a health monitoring function 126, a diagnostic function 128 and a fault isolation test function 130.

Health monitoring function 126 utilizes a health monitoring reasoner adapter 132 to which is coupled one or more dynamic reasoning algorithms 134 which are in turn provided with models 138 of the platform or LRU.

The diagnostics function is performed by a maintenance operation reasoner that includes an adapter 140 which is provided with one or more dynamic reasoning algorithms 142 that access models 138.

As to the fault isolation test function 130, this function is coupled to a script interpreter 144 provided with scripts 146. The script interpreter function can ask for manual instructions to be displayed, special bus commands through the data manager 114 to control the platform, and commands to external test equipment 151 to generate stimulus or take measurements automatically for specific fault isolation test steps 130.

The output of the executive program is coupled to report manager 118 which outputs reports to a log reporter 148 and to a display or a receiving application interface 150 to output the cause of a fault and instructions for the repair of the cause of the fault. The report manager also accepts operator inputs from the receiving application interface.

It is the purpose of module 110 to collect and process platform data, to apply transforms and perform analysis and prognostic calculations, with the information collected being time stamped and formatted for off-board transfer and processing. Note, it is the function of data manager 114 to collect and process the platform data.

As to the health monitoring function 126, module 110 collects and processes platform data and performs the health monitoring function by applying transforms and by performing trend analysis and prognostic calculations. The non-invasive analysis of detected failures is performed continuously during the normal operation of the platform in which one or more low profile reasoners may be utilized.

The health monitoring functionality also applies to embedded applications for analysis of built in test or BIT results when these results are embedded within a single LRU or embedded within the electronic control module of a platform sub-system. Note that all events are saved, time stamped and available for off-board evaluation.

As to diagnostic function 128, the diagnostics can start from the results of the on-board health monitor or the operator can select a specific LRU or subsystem. The diagnostic function will provide pass/fail information to the selected dynamic reasoning algorithm from Set 2 at 142, via the maintenance operation reasoner adapter 140. The selected reasoner will provide the name of the next fault isolation test to execute in order to fault isolate the failure. The diagnostic function 128 will then pass the name of the fault isolation test to be executed to the fault isolation test function 130 which will determine the related script to be run. The fault isolation test function will start script interpreter 144, providing it with the name of the script to be executed.

The diagnostic function 128 may employ multiple reasoners to support differing technologies. Fault isolation test function 130 controls platform and external test equipment to make testing as automatic as possible. Diagnostics in combination with fault isolation test 130 results in the reporting of maintenance actions and information to off-board systems for evaluation and continuous improvement. Finally, the diagnostics and fault isolation test functions effectively turn a Class 1 electronic technical manual into a Class 5 interactive electronic technical manual.

Utilization of the subject module enables continuous fault monitoring, fault detections, generation of alerts and warnings, entry into either tactical or maintenance modes, and provides prognostic data collection. Note that the subject system provides non-intrusive fault isolation, mission capability assessment, consumable/inventory status and configuration or state status.

Moreover, the system can provide intrusive fault isolation, remove and replace support, fault/maintenance event resolution, and fault/maintenance event logging during a session. The system also provides for a diagnostic event trace store capability, a prognostic/data collection store capability, maintenance event log storage and consumables or configurations storage.

Figure 4:
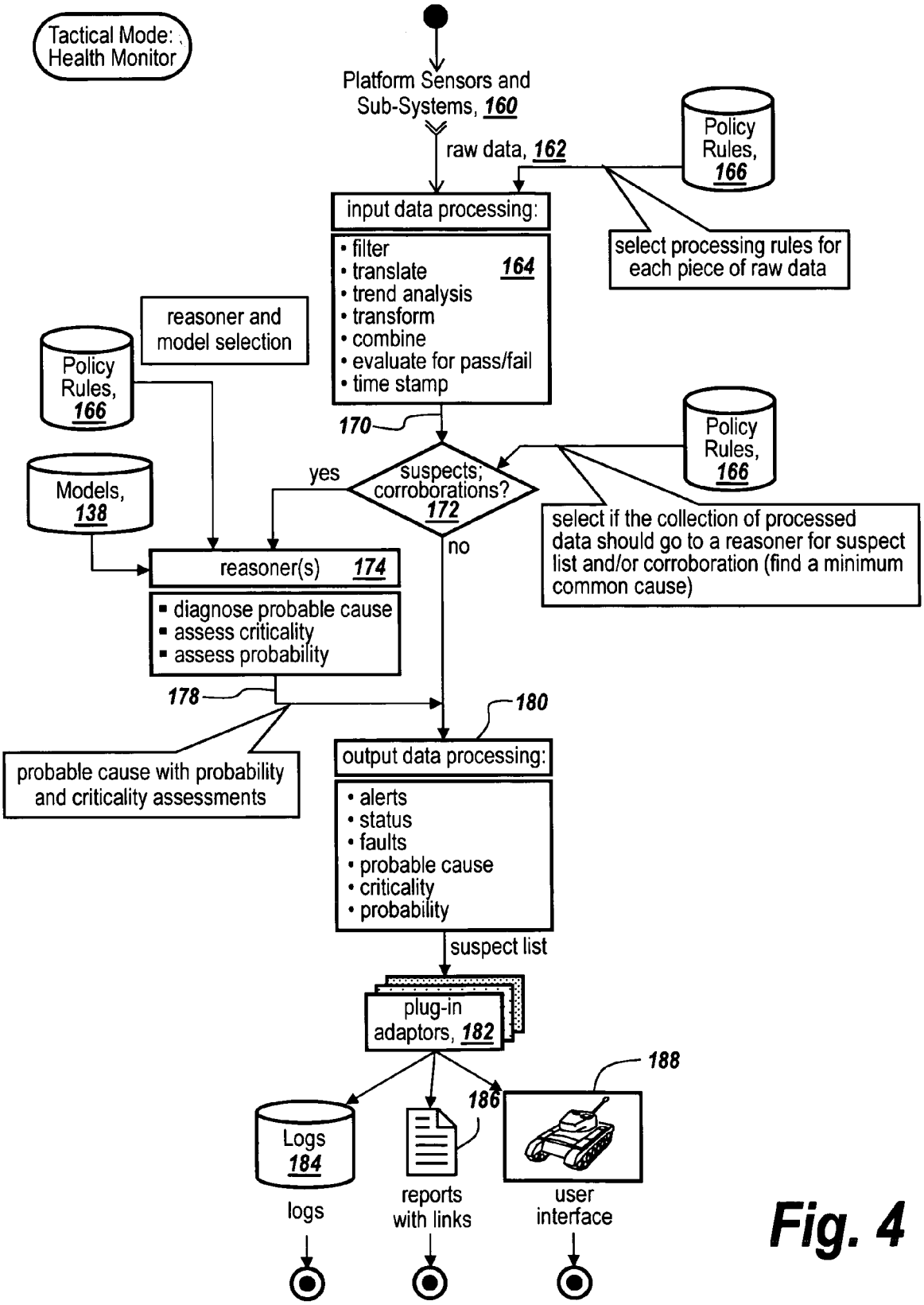

Referring now to FIG. 4, what is presented is a flow chart illustrating the operation of the health monitor in the tactical mode. It is the purpose of the health monitor to detect faults and provide a suspect list of possible causes for a fault. It also is useful to generate alarms and alerts and uses relatively low level reasoners that can isolate readily recognizable causes of certain types of faults. It is also capable of assigning probabilities and criticalities to faults so that their existence and severity can be displayed.

As can be seen, platform sensors and sub-systems 160 input raw data 162 into an input data processing node 164, represented by data manager 114 in FIG. 3, that is under the control of policy rules 166 from rule engine 112 of FIG. 3 which govern the selection of processing transforms for each piece of raw data.

As to the input data processing node 164, the raw data 162 is filtered and translated, and a trend analysis is performed, with the data being transformed, combined, and evaluated for pass/fail characteristics so that the system can, at least, ascertain whether the platform has passed or failed in any of its monitored functions. Input data is also time stamped.

Policy rules 166 specify if the result of the input data processing and the evaluation for pass/fail 170 are to be sent to a reasoner for corroboration 172. This will be the case, when based on the failures occurring, an immediate replaceable source or suspect list cannot be calculated simply. Corroboration is the determination of the minimum set of suspects that can cause the collection of passes and fails collected. If corroboration is required, a tactical mode reasoner 174 is selected which will provide a minimum list of suspects 178 with their probabilities and criticality. The models used by the selected reasoner, are available from models 138 of FIG. 3.

If a reasoner is used or not, the suspect list will go to the output data processing node 80, represented in FIG. 1 as the report manager 118, report logs 148, and display or receiving application interface 150. Output data processing block 180 outputs via a number of plug-in adapters 182 to store or log the output data, as illustrated at 184; to generate reports and links as illustrated at 186; or to provide user interface information 88 which includes alerts and suspect lists.

The process of collecting data and arriving at a suspect list with probabilities and criticalities is repeated as often as specified by the policy rules 166. Typically, this can be once every second.

Figure 5:
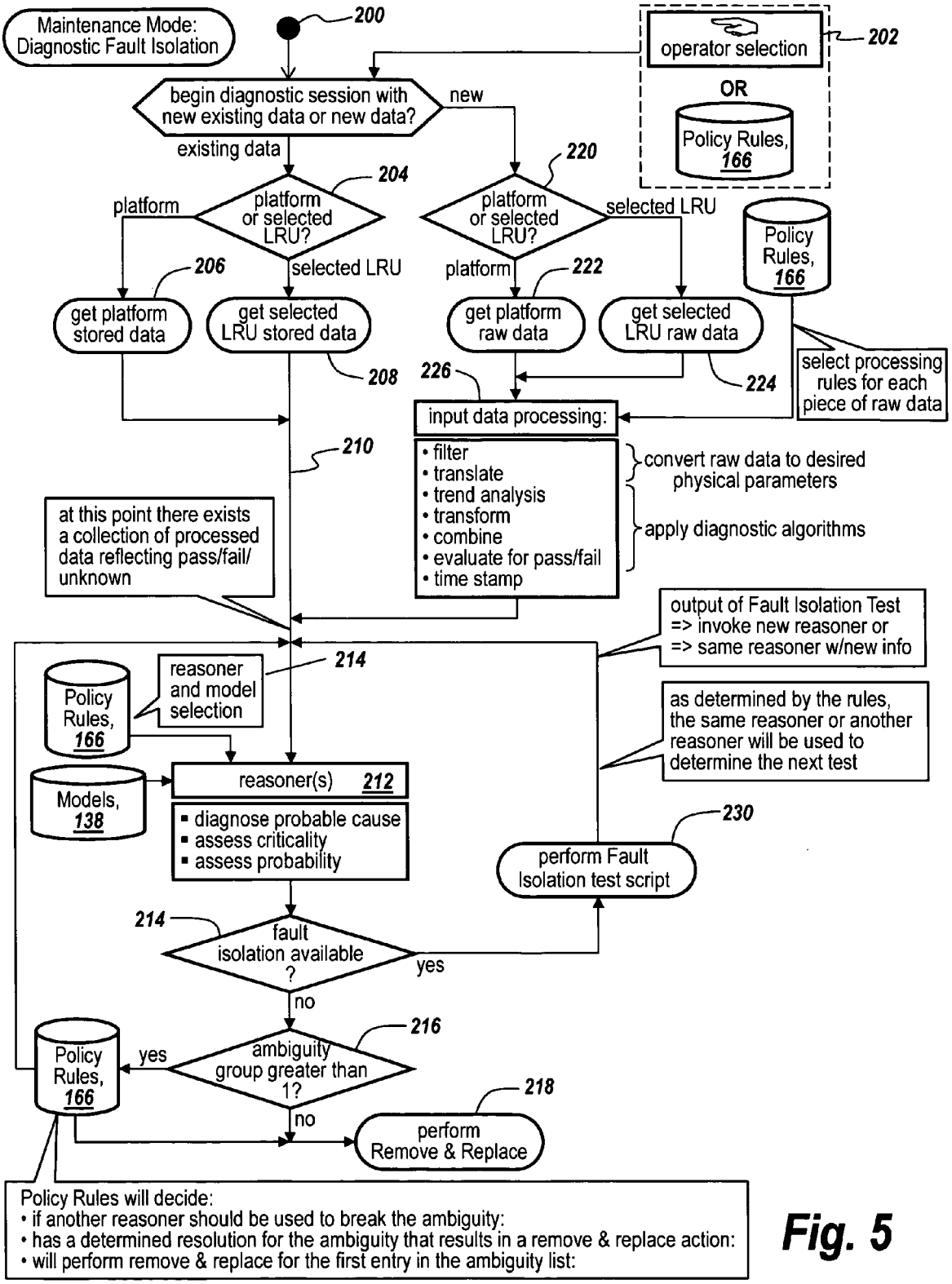

It will be appreciated that in the tactical mode the platform can be in normal operation, whereas as illustrated in FIG. 5 the system enters a maintenance mode for diagnostic fault isolation, assuming that a single replaceable part was not immediately determined in the tactical mode or if remove and replace instructions are needed.

The maintenance mode is run when the platform is not required to perform its mission and is used to diagnose the cause of a fault from the likely suspects list, with the maintenance mode invoking higher functionality reasoners.

Here as can be seen at 200, the system begins a diagnostic session with new or existing data. The maintenance mode may proceed by operator selection as shown at 202, or by policy rule 166 intervention.

If existing data is to be utilized, decision block 204 determines whether platform data is to be selected as illustrated at 206, or whether the data for a specific LRU is to be selected as illustrated at 208.

The output, as illustrated at 210, indicates that there exists a collection of processed data reflecting pass/fail/unknown characteristics which are to be applied to reasoners 212 based on reasoner and model selection 214 governed by policy rules 166. Selected models 138 are coupled to reasoners 212 to diagnose the probable cause of the fault, to assess criticality and to assess probability. The selected maintenance mode reasoner is more sophisticated than those associated with the tactical mode. Therefore, the additional piece of information it provides is the name of the next test that needs to be performed in order to isolate the failure to a single replaceable component. If the reasoner can supply the name of the next test to the diagnostics module 128 of FIG. 3, decision block 214 representing the diagnostics model will provide the information to fault isolation test module 130. The fault isolation test module will then execute the test at operation 230. Upon completion of the test, the policy rules will specify how to handle the results. The new piece of information can go to the originating reasoner or to another reasoner to determine the next fault isolation test to be executed.

If the reasoner cannot supply the name of a next test to diagnostic module 128 of FIG. 3 at decision 214, and the ambiguity group is one at decision block 216, then the remove and replace instructions 218 are presented via the report manager. If the ambiguity group is greater than one at decision block 216, then policy rules 166 will determine the course of action to be taken. The policy rules can either request, at operation 218, that the operator remove and replace the first component on the ambiguity list, or redirect diagnostic module 128 of FIG. 3 to send pass/fail information to another reasoner 212.

Going back to the start of the maintenance mode at 200, the operator could have selected to start the session with new data. In that case, the operator can select, at decision block 220, to have the subject module collect data from the entire platform as shown at operation 222, or from a specific LRU as shown at operation 224. The resultant data is processed at block 226 under control of policy rule 166 selecting the processing rules for each new piece of raw data, converting new raw data to desired physical parameters and applying selected diagnostic algorithms. The conversion of the new raw data involves filtering and translation, whereas the applying of the diagnostic algorithms includes trend analysis, transforms, combinations and evaluations for pass/fail.

The output of block 226 is then applied to reasoner block 212 wherein the processing is identical to the processing that occurred with existing data.

Figure 6:
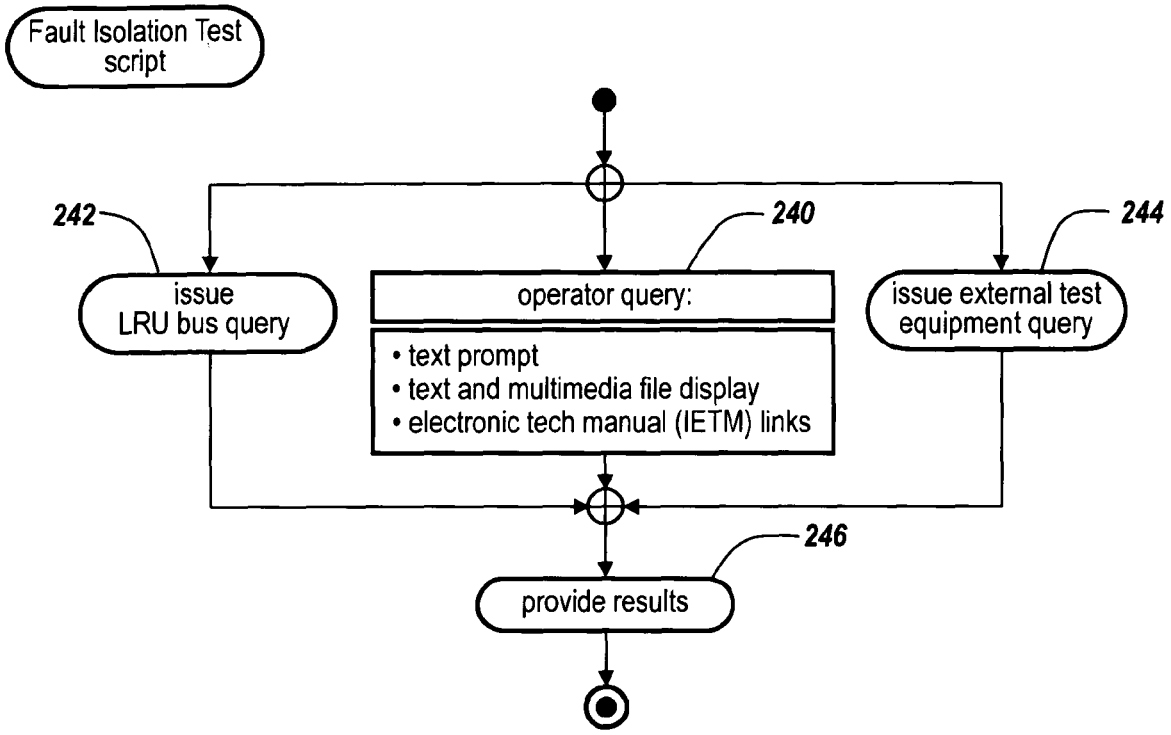
Figure 7:
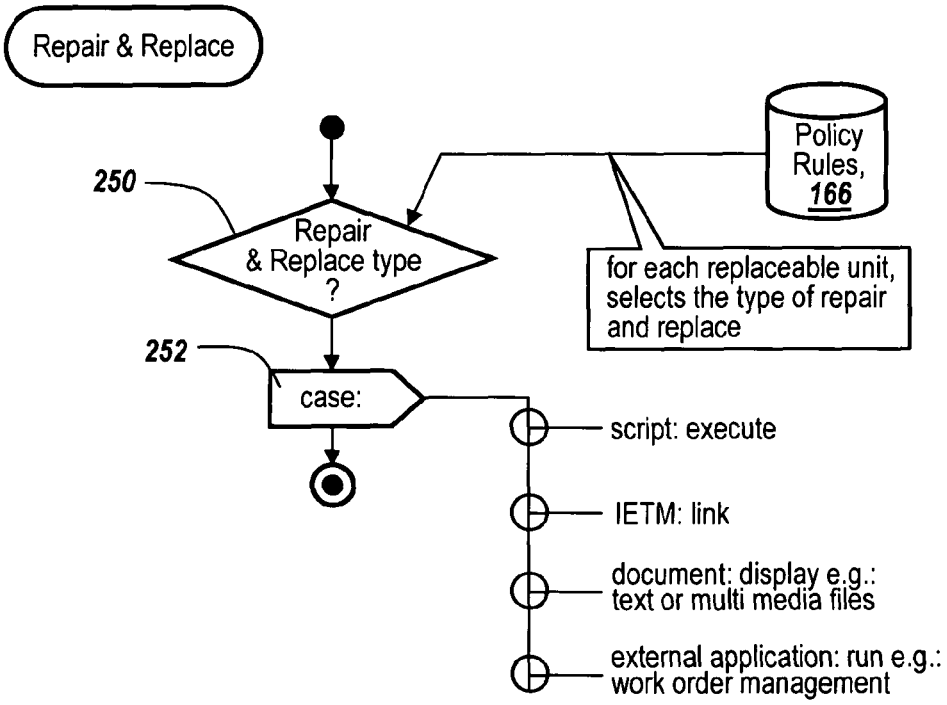

Referring to FIG. 6, the fault isolation test may be prompted by an operator query as illustrated at 240 which may include a text prompt, a text and multimedia file display, or an electronic tech manual link. The fault isolation test may also be issued as illustrated at 242 by an LRU bus query or may be issued by an external test equipment query 244. The results of the fault isolation test, however initiated, are the results 246.

With respect to the repair and replace functionality of the subject module, as illustrated at decision block 250, it is determined from policy rule 166 whether or not the type of cause of the fault is a repair and replace type. Policy rule 166 for each replaceable unit selects the type of repair and replace operation that is appropriate. Having determined that a repair and replace type of operation is required, a case 252 involves a script to initiate execution, the employment of an IETM link, and invokes generation of a document for displaying the repair and replace instructions which can include text or multimedia files. Finally case 252 can invoke an external application to run for instance, a work order management program.

Figure 8:
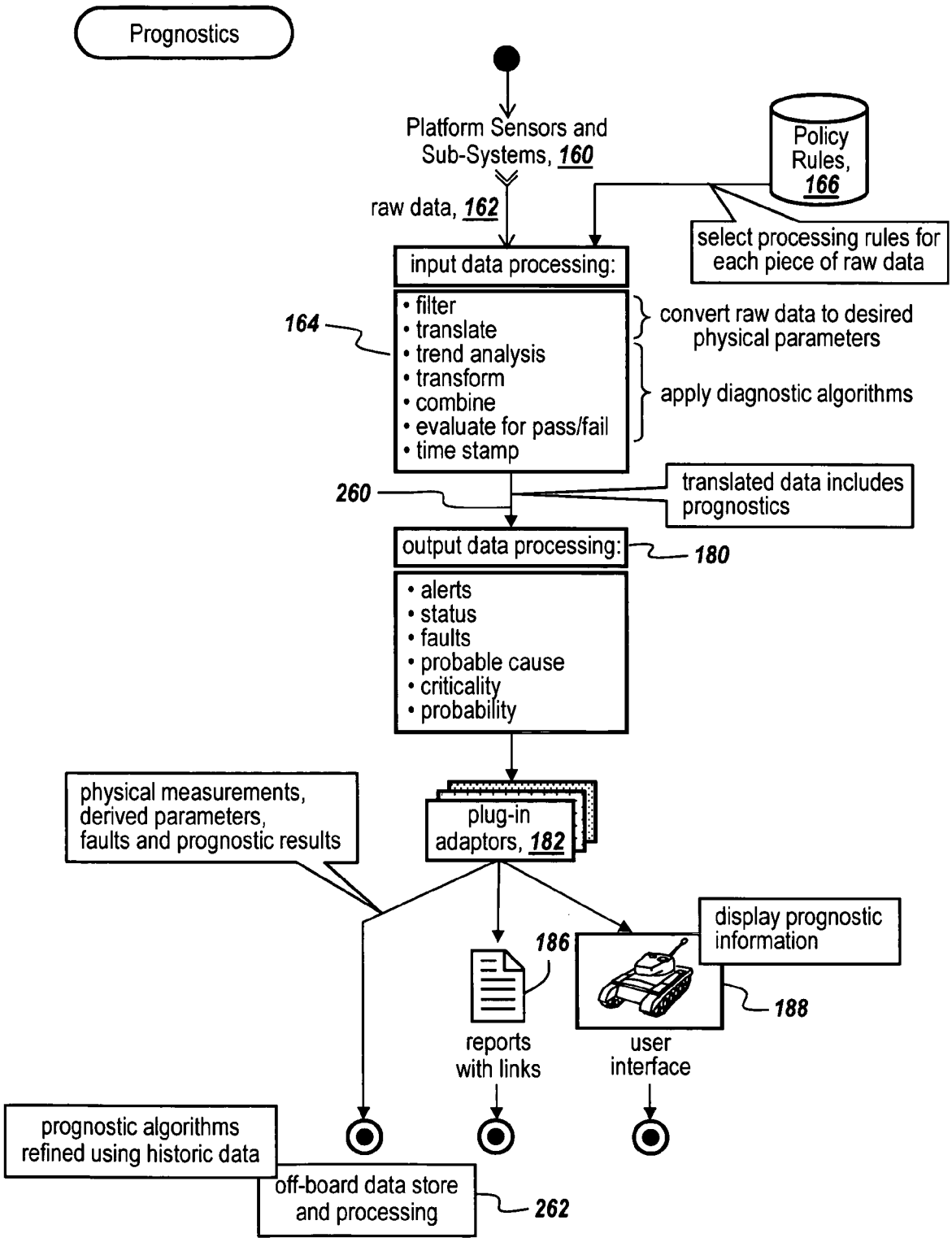

Finally with respect to prognostics and referring now to FIG. 8, this portion of the subject module predicts future platform faults. Here platform and sensor sub-systems 160 output raw data 162 to input data processing block 164 which selects processing rules for each piece of raw data, converts the raw data to desired physical parameters and applies prognostic algorithms to predict future faults.

As illustrated at output 260, the translated data includes prognostics which are applied to the output data processing block 180 that generates alerts, status, faults, probable cause, criticality, and probability data. This data is outputted to plug-in adapters 182 that in one embodiment outputs physical measurements, drive parameters, faults and prognostic results to off-board data store and processing block 262, with the prognostic algorithms refined using historic data. Also as illustrated at 188 the prognostic information is displayed, with reports and links at 86 being updated with the prognostic output.

More particularly, at the platform the subject module provides a Maintenance Management System (MMS) by virtue of the platform interface, the downloading of the entire platform record and the MMS load into a platform record on a Portable Maintenance Aid (PMA) or physical medium attachment.

The module also assists in off-platform activities such as the association of records into generalized maintenance databases, Reliability Centered Maintenance (RCM)/Condition Based Maintenance (CBM+)/diagnostics/prognostics analysis and the translation of data into other information and knowledge-based systems. Tactical platform health status can be maintained, as well as tactical platform logistics and maintenance status. Moreover, original equipment manufacturer support and improvement intelligence is supported by the subject module.

It will be noted that the rules engine initializes the units involved in the measurements, namely metric English or both, defines the input parameters including the Diagnostic Trouble Codes (DTC) for each input parameter, and defines the data transforms to be applied, e.g. offset and scaling; assigns scripts for filtering, calls up complex transforms, generates derived parameters, defines the parameter user-friendly name, defines the parameter units, e.g. inches, pounds per square inch, . . . and defines pass/warn/fail limits for the particular platform involved. Finally, the rules engine specifies the expected repeat rate and time outs for the diagnostic trouble codes.

By way of further explanation, data manager 114 provides the interface to the module from the platform hardware interface adapter. It converts raw data to desired units by directly applying simple transforms or by calling up the appropriate script for the selected complex transform. It also provides data buffering and queue management and evaluates data against pass/fail/warn limits.

In one embodiment, script interpreter 122 incorporate an embedded commercial off-the-shelf script engine, with scripts 124 being stored for filtering, complex transforms and the generation of derived parameters.

Having connected subject module 110 to the platform, when performing a health monitoring function, module 110 software reduces its potential impact on the normal system operation by minimizing the computer memory and CPU cycles needed. This is accomplished by using highly optimized code which is tightly coupled wherever possible. To ensure minimum impact to normal operation, dynamic reasoners are used in a fully automated fashion without manual intervention or operator queries.

Module 110 may be configured to call up any number of dynamic reasoners during health monitoring including those available commercially as long as they meet some key requirements. The requirements include using few CPU resources, the ability to reach conclusions in almost real-time, the ability to operate on a continuing stream of changing input data, the ability to provide ambiguity group results that are expressed in terms of replaceable units that use past as well as failed tests to arrive at reasoning conclusions, the ability to handle single point and multiple point failure sources, the ability to provide a mechanism to document reasoning flows, and the ability to provide a mechanism to perform regression testing.

In the health monitoring mode, rules engine 112 defines which health monitoring reasoning adapter to load and use. Thereafter, the rules engine specifies or maps platform systems to capabilities, e.g. in the case of a vehicle, the mapping of engine capabilities to mobility. The rules engine then makes sure that health monitoring faults to criticality.

Rules engine 112 provides that executive program 116 manage the module software state during startup, health monitoring, maintenance operations, and shut down and maintains the health monitoring fault list including diagnostic trouble codes, DTC, as well as built-in test and other codes. The executive program also sends alerts and requested health monitoring data to report manager 18.

Health monitoring reasoner adapter 132 adapts between standard functions and data formats and reasoner specific functions and data formats. In one embodiment, adapter 132 operates in a bi-directional manner. Reasoner adapter 132 also loads and controls the selected health monitoring reasoner.

It will be appreciated that the dynamic reasoning algorithms of Set 1 are used to reduce ambiguities in the health monitoring fault list as far as possible without executing interactive BIT or fault isolation tests.

Note further that the health monitoring function requires that the reasoner access platform-specific diagnostic model 138. The health monitoring reasoner detects faults and provides a number of suspect causes for a fault, thereby to generate a number of ambiguity groups from which the likely cause of the fault is to be ascertained.

Determination of the likely fault is the function of diagnostics 128 in which module 110 calls up any number of dynamic reasoners in Set 2 during the maintenance operation. The dynamic reasoners may be commercially available as long as they meet the following key requirements. They must be able to start from the ambiguity groups determined during the health monitoring function. They must be able to work with the results of externally controlled test activities and be able to support manually controlled test activities and operate on the results. They must also be able to include the results of test activities to determine the next test to be performed and must be able ultimately to diagnose a failure in terms of replaceable units. Also the dynamic reasoner must be able to handle single point and multiple point failure sources and provide a mechanism to document reasoning flows as well as a mechanism to perform regressive testing.

It will be appreciated that rules engine 112 finds which maintenance operation reasoning adapter to load and use.

In this regard, the maintenance operation reasoning adapter 140 couples selected dynamic reasoning algorithms from Set 2 that access model 138.

After ascertaining the likely cause of the fault, a fault isolation test is performed under the control of script interpreter 144 which employs an embedded script engine and is loaded with scripts 146 which stores scripts for executing interactive BIT and fault isolation test requests.

With respect to output processing, report manager 118 has available to it a number of report plug-ins to load, with the loaded plug-in being controlled by rules engine 112. As a result, report manager 118 loads and controls report plug-ins, with the plug-ins mapping health monitoring, diagnostic and prognostic data in "views" for display, with report manager 118 responsible for logging and report generation.

It is noted that report logs 148 are formatted for data, typically SML data for report generation. Finally, the report manager is coupled to the display or receiving application interface for reporting the likely cause of the fault and to provide immediately-available instructions for the repair of the platform.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for detecting catastrophic failure of a man lift, comprising the steps of:

sensing a pressure utilized to raise and lower the man lift using a sensor so as to provide monitored data; and, processing the monitored data for a change in the pressure while the man lift is in operation that would indicate the imminence of the catastrophic failure so as to provide an alarm indicative of the imminence of the catastrophic failure, whereby a man lift operator is lowered to safety before the catastrophic failure, the processing further includes the step of utilizing a prognostication algorithm for predicting the catastrophic failure, the prognostication algorithm determining when the pressures during the elevation of the man lift drop below a predetermined line or drop below a predetermined change indication an abrupt change to indicate the potential catastrophic failure.

2. The method of claim 1, wherein the operating parameters of the man lift are utilized in the initialization of the prognostication algorithm.

3. The method of claim 2, wherein the prognostication algorithm takes into account one of absolute pressure changes, relative pressure changes or changes in pressure in either the absolute pressure or relative pressure that would lead to a defined fault condition for the man lift.

4. The method of claim 3, wherein the defined fault condition is the man lift failure.

5. The method of claim 1, and further including the step of automatically lowering the man lift based on an indication of the imminence of the catastrophic failure.

6. Apparatus for detecting catastrophic failure of a man lift, comprising:

the man lift including a pivoted elevatable boom having a bucket at its distal end thereof;

a source of hydraulic fluid under pressure;

a hydraulic actuator coupled to said boom for moving said boom in accordance with the hydraulic pressure applied thereto, said hydraulic actuator including a hydraulic motor coupled to said hydraulic actuator through the use of a conduit which supplies the hydraulic fluid from said source to said hydraulic motor;

a pressure sensor located at said conduit for monitoring the pressure of the hydraulic fluid in said conduit;

a processor coupled to the output of said pressure sensor for determining the imminence of the catastrophic failure of said man lift, said processor further including the step of utilizing a prognostication algorithm for predicting the catastrophic failure, the prognostication algorithm determining when the pressures during the elevation of the man an lift drop below a predetermined line or drop below a predetermined change indicating an abrupt change to indicate the potential catastrophic failure; and an alarm operably coupled to said processor for indicating the imminence of the sensed catastrophic failure.

7. The apparatus of claim 6, and further including a man lift lowering module operably coupled to said processor and said hydraulic motor for causing said boom to be lowered to its rest position upon sensing of said imminence of said catastrophic failure.

8. The apparatus of claim 6, wherein said prognostication algorithm is initialized based on one or more operational parameters of said man lift.

9. The apparatus of claim 8, wherein said operational parameters include expected hydraulic pressures and hydraulic pressure limits indicative of the man lift failure.

10. The apparatus of claim 9, wherein said prognostication algorithm monitors sensed hydraulic pressure over the time that said man lift is in operation.

11. The apparatus of claim 10, wherein said prognostication algorithm includes fault determining data specific to said man lift.

12. The apparatus of claim 11, wherein said fault determining data includes hydraulic actuator failure data.

13. The apparatus of claim 12, wherein said prognostication algorithm is initiaiized with at least one fault mode of said man lift.

14. The apparatus of claim 13, wherein said at least one fault mode includes the weight of said bucket, the weight of an individual in said bucket, and the hydraulic pressure used to raise said bucket and said individual from a rest position of said boom.

15. The apparatus of claim 13, wherein the at least one fault mode includes hydraulic failure.

16. The apparatus of claim 13, wherein the at least one fault mode includes man lift tipping.

* * * * *